United States Patent [19]

Babberl

[11] 4,270,291

[45] Jun. 2, 1981

[54] SIGN CONSTRUCTION

[75] Inventor: Marion G. Babberl, San Mateo, Calif.

[73] Assignee: Rapid Mounting & Finishing Company, Chicago, Ill.

[21] Appl. No.: 149,677

[22] Filed: May 14, 1980

[51] Int. Cl.[3] ..... G09F 7/00

[52] U.S. Cl. ..... 40/594; 40/530; 40/610

[58] Field of Search ..... 40/594, 595, 10 R, 10 D, 40/530, 491, 488, 486, 610, 611, 584, 497

[56] References Cited

U.S. PATENT DOCUMENTS

| | | | |
|---|---|---|---|
| 2,710,474 | 6/1955 | Hynek | 40/610 |
| 3,248,806 | 5/1966 | Schrader | 40/530 |
| 3,769,727 | 11/1973 | Kent | 40/488 |
| 3,903,629 | 9/1975 | Gruna | 40/584 X |
| 4,182,063 | 1/1980 | Klosel | 40/610 |
| 4,217,713 | 8/1980 | Greenberger | 44/491 X |

*Primary Examiner*—John F. Pitrelli

*Attorney, Agent, or Firm*—Wegner, Stellman, McCord, Wood & Dalton

[57] ABSTRACT

A sign construction having a plurality of movably connected panels including a mounting panel and panels successively hung from the lower edge of the mounting panel. In the illustrated embodiment, the sign construction includes an upper mounting panel having structure for securing the mounting panel facially to a windowpane. The panel portions hanging from the mounting panel define selective information-conveying sign structure and, in the illustrated embodiment, include an upper panel portion and a lower panel portion which are hingedly connected to permit the lower panel portion to selectively hang downwardly from the upper panel portion or be retained between the front face of the upper panel portion and the windowpane as a result of hinged swinging of the lower panel portion upwardly from the hanging disposition. The connection of the upper edge of the upper panel portion to the lower edge of the mounting panel, in the illustrated embodiment, is provided by a hinge. The front face of the mounting panel may be provided with an indicium. The front faces of the upper and lower panel portions may be provided with an indicium. The rear face of the lower panel portion may be provided with an indicium. The rear faces of the mounting panel and upper panel portion may be provided with an indicium.

14 Claims, 4 Drawing Figures

FIG. 1
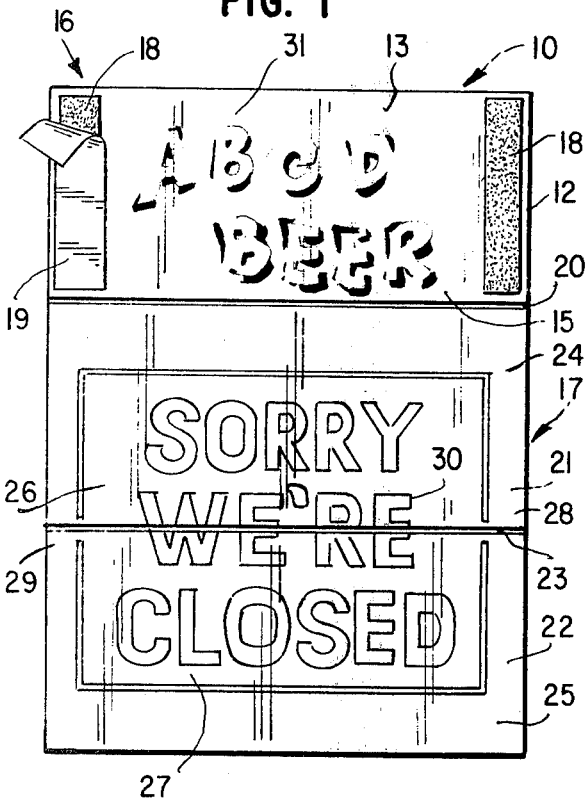
FIG. 2
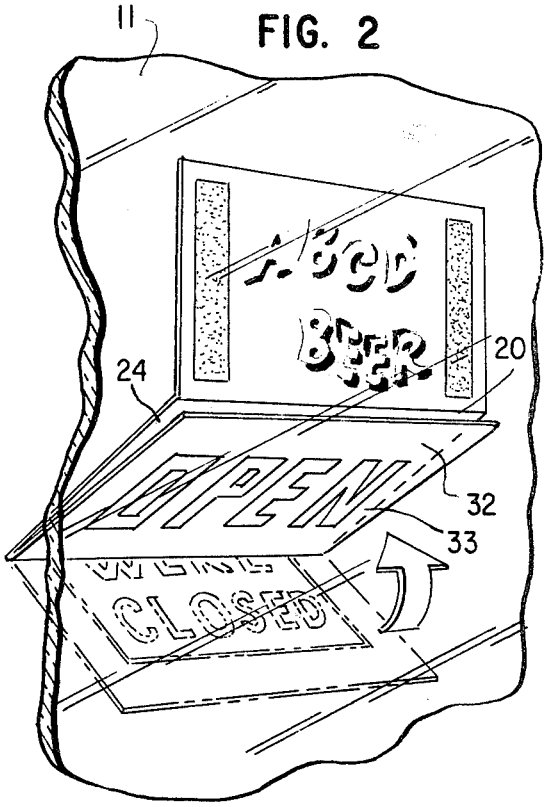
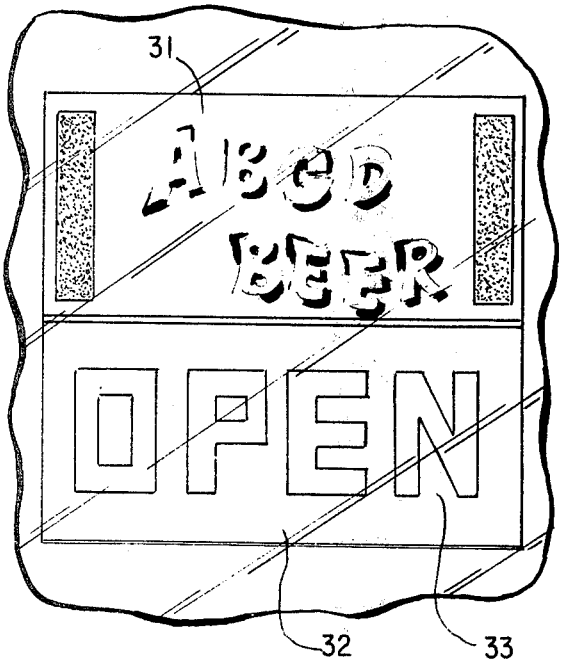
FIG. 3
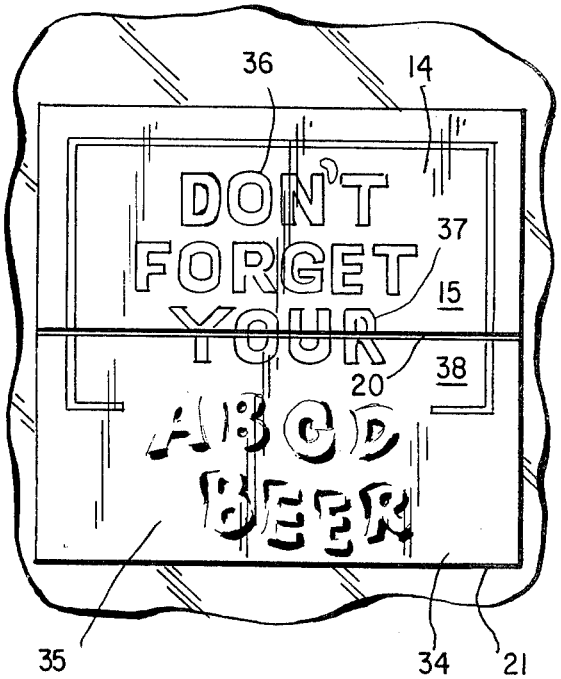
FIG. 4

SIGN CONSTRUCTION

BACKGROUND OF THE INVENTION

1. Field of the Invention

This invention relates to sign constructions and/in particular, to sign constructions adapted to be associated with windowpanes or the like for viewing therethrough.

2. Description of the Background Art

In one conventional form of sign construction for use in providing information through a windowpane or the like, a panel is provided on its opposite faces with different information-bearing indicia. The user of the sign construction alternatively mounts the panel so as to display either of the two faces appropriate for the desired information transmission through the windowpane.

Such a sign construction has the disadvantage of presenting undesired information indicia viewable from rearwardly of the sign construction, i.e. looking outwardly in a direction through the windowpane. Thus, for example, where the sign construction bears the information indicium OPEN on one face and the information indicium CLOSED on the opposite face, the indicium CLOSED would be normally viewable by one looking at the rear face when the front face is positioned to be viewable through the windowpane.

One solution to this problem is to provide separate sign constructions such that one may be taken down when the other one is placed in position for viewing through the windowpane. The latter arrangement has the disadvantage of increased possibility of loss of one or the other of the two panels.

SUMMARY OF THE INVENTION

The present invention comprehends an improved sign construction arranged to provide selectively different information for viewing through a windowpane or the like while yet preventing undesirable display rearwardly therefrom.

More specifically, the invention comprehends providing such an improved sign construction including a mounting panel having a front face and a rear face and a lower edge portion, holding means on the front face for holding the panel with the front face in facial juxtaposition to a windowpane and with the lower edge portion lowermost, a selective information-conveying sign structure including an upper panel portion and a lower panel portion, the upper panel portion having a front face, a rear face, a lower edge portion and an upper edge portion, the lower panel portion having a front face, a rear face, a lower edge portion and an upper edge portion, connecting means connecting the upper edge portion of the upper panel portion to the lower edge portion of the mounting panel, hinge means hingedly connecting the upper edge portion of the lower panel portion to the lower edge portion of the upper panel portion for selectively (a) hanging the lower panel portion downwardly from the upper panel portion so as to have the front faces of the mounting panel, upper panel portion and lower panel portion facially juxtaposed to the windowpane for viewability therethrough, and (b) carrying the lower panel portion on the lower edge portion of the upper panel portion with the lower panel portion extending upwardly therefrom so as to be disposed between the upper panel portion and windowpane substantially aligned with the mounting panel and so as to have the rear face of the lower panel portion and front face of the mounting panel concurrently viewable through the windowpane, and information-conveying means on a plurality of the faces.

The connecting means may comprise hinge means and, in the illustrated embodiment, the sign structure is hingedly carried on the lower edge of the mounting panel.

In the illustrated embodiment, each of the mounting panel, the upper panel portion, and the lower panel portion is of substantially the same configuration.

In the illustrated embodiment, the holding means comprises means for securing the mounting panel to the windowpane and, more specifically, in the illustrated embodiment, comprises adhesive securing means.

In the illustrated embodiment, the securing means is provided along at least one edge portion of the mounting panel.

Further more specifically, the sign construction includes first indicia means on the front face of the upper panel portion and front face of the lower panel portion providing first information through the windowpane when the lower panel portion is selectively disposed to hang downwardly from the upper panel portion, and second indicia means on the rear face of the lower panel portion providing second information through the windowpane when the lower panel portion is extended upwardly from the lower edge between the upper panel portion and the windowpane with the rear face of the lower panel portion juxtaposed to the windowpane.

In the illustrated embodiment, the front face of the mounting panel is provided with indicia means which is viewable through the windowpane at all times when the mounting panel is secured thereto.

In the illustrated embodiment, the rear face of the mounting panel and the rear face of the upper panel portion of the sign structure may be provided with indicia means which are viewable at all times when the sign construction is installed on the windowpane.

One or more of the indicia may be defined by lettering having a portion thereof disposed on adjacent panel means.

The sign construction of the present invention is extremely simple and economical while yet providing the highly desirable features discussed above.

BRIEF DESCRIPTION OF THE DRAWING

Other features and advantages of the invention will be apparent from the following description taken in connection with the accompanying drawing wherein:

FIG. 1 is a front elevation of a sign construction embodying the invention illustrating the removal of a protective strip overlying a portion of the adhesive securing means of the mounting panel;

FIG. 2 is a fragmentary view illustrating the selective positioning of the lower panel portion from the position of FIG. 1 toward a reversed arrangement of FIG. 3;

FIG. 3 is a front elevation of the sign construction illustrating the same in the reverse arrangement; and FIG. 4 is a rear elevation of the sign construction as arranged in the disposition of FIG. 3.

DESCRIPTION OF THE PREFERRED EMBODIMENT

In the illustrative embodiment of the invention as disclosed in the drawing, a sign construction generally designated 10 is shown to comprise a selectively positionable structure adapted to be mounted on a windowpane 11, or the like, for selective viewing through the windowpane of two different arrangements of the sign construction, such as illustrated in FIGS. 1 and 3.

More specifically, in the illustrated embodiment, the sign construction includes an upper mounting panel 12 having a front face 13, a rear face 14 (see FIG. 4), and a lower edge portion 15.

The invention comprehends the provision of holding means generally designated 16 for holding the mounting panel in facial juxtaposition to the windowpane 11 with an information-conveying sign structure generally designated 17 hanging downwardly therefrom. In the illustrated embodiment, holding means 16 comprises means for securing and mounting panel 13 to the windowpane, as illustrated in FIG. 2. As shown in FIG. 1, the holding means may comprise a plurality of adhesive portions 18 provided on peripheral portions of the mounting panel. In the illustrated embodiment, the adhesive portions are defined by contact adhesive means and, thus, may be further provided with a protective removable strip 19, which may be removed, as illustrated in FIG. 1, immediately prior to the placement of the mounting panel in position against the surface of the windowpane 11. Suitable contact adhesive materials for such use are well known in the art and require no further description herein.

As indicated briefly above, the sign structure 17 is arranged to hang from the lower edge 15 of the mounting panel and, in the illustrated embodiment, is connected thereto by a hinge 20. Sign construction 17 includes an upper panel portion 21 and a lower panel portion 22 hingedly connected to the upper panel portion by a hinge 23 so that in one arrangement of the sign construction, as illustrated in FIG. 1, lower panel portion 22 hangs downwardly from upper panel portion 21, which, in turn, hangs downwardly from the mounting panel 13.

As illustrated in FIG. 1, front face 24 of upper panel portion 21 and front face 25 of lower panel portion 22 are provided with first indicia means 26 and second indicia means 27, respectively. The lower edge portion 28 of the upper panel portion 21 is hingedly connected to the upper edge portion 29 of the lower panel portion by the hinge means 23. Further, as seen in FIG. 1, lettering 30 of the indicia means 26 and 27 comprises a portion of the indicia means extending across the hinge means 23 and, thus, disposed partially on the upper panel portion 21 and on the lower panel portion 22.

As further shown in FIG. 1, front face 13 of mounting panel 12 may be provided with an information indicium 31 which is viewable at all times through the windowpane 11 when the mounting panel is mounted to the windowpane, as illustrated in FIG. 2. In the illustrated embodiment, the indicium 31 illustratively comprises advertising material. Indicia means 26 and 27 cooperatively provide information, such as the illustratively disclosed information "SORRY WE'RE CLOSED".

As further illustrated in FIGS. 2 and 3, lower panel portion 22 defines a rear face 32 carrying a further information indicium 33. When it is desired to display the indicium 33 through the windowpane 11 in lieu of the cooperating indicia means 26 and 27, the user merely swings the upper panel portion 21 rearwardly from the windowpane on hinge 15 to permit subsequent swinging of the lower panel portion 22 forwardly and upwardly to underlie the front face 24 of the upper panel portion, as illustrated in FIG. 2. The juxtaposed panel portions 21 and 22 are then allowed to swing downwardly on hinge 20 to bring the face 32 of the lower panel portion into facial juxtaposition to the windowpane substantially parallel to the mounting panel 12, as illustrated in FIG. 3.

The folded arrangement of the panel portions 21 and 22 about the hinges 20 and 23 effectively retains the sign structure 17 in the folded arrangement so as to maintain the indicium 33 in displayed disposition through the windowpane 11, as illustrated in FIG. 3.

The rear face 34 of upper panel portion 21 is provided with an indicium means 35 which cooperates with an indicium means 36 on the rear face 14 of mounting panel 12, as illustrated in FIG. 4, to provide further information viewable from the rear of the sign construction when the sign construction is in the disposition of FIG. 3. As shown in FIG. 4, indicia 35 and 36 may include a lettering portion 37 having portions respectively on the lower edge portion 15 of the mounting panel and upper edge portion 38 of the upper panel portion 21.

Thus, as a result of the unique construction of the sign means 10, alternative information indicia may be displayed through the windowpane 11, as desired by the user. In the arrangement of FIG. 1, both an advertising indicium and information indicium may be provided. By the simple expedient of swinging the lower panel portion of the sign structure 17 hingedly upwardly to between the upper panel portion 21 and the windowpane 11, a second information indicium may be presented for viewing through the windowpane 11 in combination with the advertising indicium 31 maintained in viewing position on the mounting panel.

When the sign construction is arranged in the alternative disposition of FIG. 3, the rearwardly exposed portions thereof provide cooperating indicia 35 and 36 while viewing from rearwardly of the sign construction.

As the selective retention of the sign structure 17 in either of the depending arrangements of FIG. 1 or folded arrangement of FIG. 3 may be readily effected by simple swinging movement of the respective panels while the mounting panel is maintained secured to the windowpane, improved selective provision of the desired information through the windowpane is readily effected while yet the sign construction is maintained at all times in association with the windowpane to avoid loss of all or portions thereof as may occur in the prior art structures as discussed above.

In the illustrated embodiment, the mounting panel and panel portions are formed of cardboard or the like. Illustratively, the hinges 15 and 23 may be defined by overlying transparent plastic sheeting on the surfaces of the panel extending between the respective panels, and in the illustrated embodiment, such plastic sheeting may be provided on both the front and rear surfaces of the panels.

Thus, as discussed above, the sign construction 10 is extremely simple and economical while yet providing a highly improved, low cost sign structure for facilitated display of selective information indicia through a windowpane or the like.

The foregoing disclosure of specific embodiments is illustrative of the broad inventive concepts comprehended by the invention.

I claim:

1. For use with a light-transmitting windowpane, a sign construction comprising:

a mounting panel having a front face, a rear face, and a lower edge portion;

holding means on the front face for holding the panel with the front face in facial juxtaposition to a windowpane and with the lower edge portion lowermost;

a selective information-conveying sign structure including an upper panel portion and a lower panel portion, the upper panel portion having a front face, a rear face, a lower edge portion, and an upper edge portion, the lower panel portion having a front face, a rear face, a lower edge portion, and an upper edge portion;

connecting means connecting said upper edge portion of the upper panel portion to said lower edge portion of the mounting panel;

hinge means hingedly connecting said upper edge portion of the lower panel portion to said lower edge portion of the upper panel portion for selectively (a) hanging said lower panel portion downwardly from the upper panel portion so as to have said front faces of the mounting panel, upper panel portion, and lower panel portion facially juxtaposed to the windowpane for viewability therethrough, and (b) carrying the lower panel portion on said lower edge portion of the upper panel with the lower panel portion extending upwardly therefrom so as to be disposed between said upper panel portion and windowpane substantially aligned with said mounting panel and so as to have said rear face of the lower panel and front face of the mounting panel concurrently viewable through the windowpane; and information-conveying means on a plurality of said faces.

2. The sign construction of claim 1 wherein said connecting means comprises hinge means.

3. The sign construction of claim 1 wherein said upper panel portion and said lower panel portion are of substantially the same configuration.

4. The sign construction of claim 1 wherein said mounting panel, upper panel portion and said lower panel portion are of substantially the same configuration.

5. The sign construction of claim 1 wherein said holding means comprises means for securing the mounting panel to the windowpane.

6. The sign construction of claim 1 wherein said holding means comprises adhesive means for securing the mounting panel to the windowpane.

7. The sign construction of claim 1 wherein said holding means comprises means for securing at least one edge portion of the mounting panel to the windowpane.

8. The sign construction of claim 1 wherein said display means comprises indicia means.

9. For use with a light-transmitting windowpane, a sign construction comprising:

a mounting panel having a front face, a rear face, and a lower edge portion;

holding means on the front face for holding the panel with the front face in facial juxtaposition to a windowpane and with the lower edge portion lowermost;

a selective information-conveying sign structure including an upper panel portion and a lower panel portion, the upper panel portion having a front face, a rear face, a lower edge portion, and an upper edge portion, the lower panel portion having a front face, a rear face, a lower edge portion, and an upper edge portion;

connecting means connecting said upper edge portion of the upper panel portion to said lower edge portion of the mounting panel;

hinge means hingedly connecting said upper edge portion of the lower panel portion to said lower edge portion of the upper panel portion for selectively (a) hanging said lower panel portion downwardly from the upper panel portion so as to have said front faces of the mounting panel, upper panel portion, and lower panel portion facially juxtaposed to the windowpane for viewability therethrough, and (b) carrying the lower panel portion on said lower edge portion of the upper panel with the lower panel portion extending upwardly therefrom so as to be disposed between said upper panel portion and windowpane substantially aligned with said mounting panel and so as to have said rear face of the lower panel and front face of the mounting panel concurrently viewable through the windowpane;

first indicia means on said front face of the upper panel portion and front face of the lower panel portion providing first information through the windowpane when the lower panel portion is selectively disposed to hang downwardly from said upper panel portion; and second indicia means on said rear face of the lower panel portion providing second information through the windowpane when the lower panel portion is extended upwardly from said lower edge between said upper panel portion and the windowpane with said rear face of the lower panel portion juxtaposed to the windowpane.

10. The sign construction of claim 9 wherein said first indicia means includes lettering having an upper portion on said upper panel portion and a lower portion on said lower panel portion.

11. The sign construction of claim 9 wherein third indicia means are provided on said rear face of the mounting panel and rear face of said upper panel portion viewable from rearwardly of the sign construction.

12. The sign construction of claim 9 wherein third indicia means are provided on said rear face of the mounting panel and rear face of said upper panel portion viewable from rearwardly of the sign construction and said third indicia includes lettering having an upper portion on said mounting panel and a lower portion on said upper panel portion.

13. The sign construction of claim 9 wherein the front face of the mounting panel is provided with indicia means.

14. The sign construction of claim 9 wherein third indicia means are provided on said rear face of the mounting panel and rear face of said upper panel portion viewable from rearwardly of the sign construction and fourth indicia means are provided on the front face of the mounting panel.

* * * * *